United States Patent [19]

Sugahara

[11] 3,985,088

[45] Oct. 12, 1976

[54] CLOTH FEED DEVICE FOR BLIND STITCH SEWING MACHINE

[76] Inventor: Masato Sugahara, 3-chome, 28-12 Nishi Asakusa, Taito, Tokyo, Japan

[22] Filed: Jan. 16, 1975

[21] Appl. No.: 541,571

[30] Foreign Application Priority Data

Mar. 12, 1974 Japan ..... 49-028934

[52] U.S. Cl. ..... 112/178; 112/209

[51] Int. Cl.[2] ..... D05B 1/24

[58] Field of Search ..... 112/178, 212, 208, 209

[56] References Cited

UNITED STATES PATENTS

| | | | |
|---|---|---|---|
| 1,297,920 | 3/1919 | Seymour | 112/209 |
| 1,548,962 | 8/1925 | Tate | 112/209 |
| 1,602,145 | 10/1926 | Avis | 112/208 |
| 1,984,593 | 12/1934 | Mueller | 112/212 |
| 2,102,202 | 12/1937 | Ebert | 112/208 |

*Primary Examiner*—Werner H. Schroeder
*Assistant Examiner*—Peter Nerbun

[57] ABSTRACT

A cloth feed device for blind stitch sewing machines comprises two cloth feed racks disposed in a direction perpendicular to a cloth feed direction and the two cloth feed racks are operatively connected to a main shaft of the sewing machine body, respectively, thereby obtaining individual and proper feed of each of the upper and lower cloth to be stitched.

1 Claim, 9 Drawing Figures

CLOTH FEED DEVICE FOR BLIND STITCH SEWING MACHINE

BACKGROUND OF THE INVENTION

The present invention relates to an improvement in a cloth feed device for blind stitch sewing machines.

In such a cloth feed device of the prior art a cloth feed rack is secured to a locking lever which is connected to a main driving shaft of a sewing machine body so as to allow the locking lever to reciprocate to vertical and transverse directions.

A brief description of the prior art and brief summary of the invention follows a brief summary of the drawings so that the deficiencies of a conventional cloth feed device can be discussed with reference to the drawings.

BRIEF DESCRIPTION OF THE INVENTION

Certain objects and advantages of the present invention will become apparent from the following description of embodiments with reference to the accompanying drawing in which:

1A is a plan view showing a cloth blind stitched in a conventional manner;

DETAILED DESCRIPTION OF THE INVENTION

Figure 1:
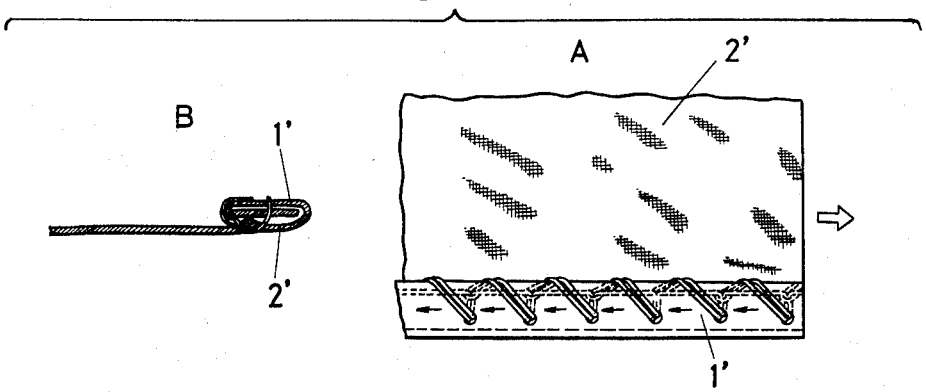
FIG. 1B is a longitudinal sectional view of the cloth of FIG. 1.

FIG. 1 shows a lower cloth 2′ having a turned up edge forming an upper cloth 1′. During blind stitching of the turned-up portion of the cloth edge, the cloth is fed in the direction shown by the open arrow. When conventional cloth feed devices are used, the upper cloth 1′ tends to be pulled by the thread in a direction opposite to the cloth feed direction as shown by the dark arrows. Therefore, the upper cloth 1′ lags to the rear forming a defect in the blind stitch. Consequently, a lower cloth or padding cloth cannot be stitched to the edge of a surface cloth because of the non-uniform feed between the two cloths.

Figure 2:
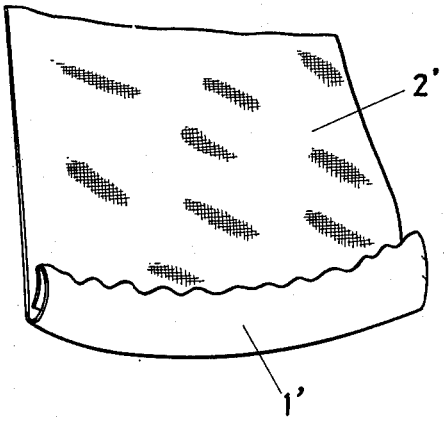
FIG. 2 is a view of a skirt cloth to be blind stitched.

Particularly, in the case of a turned-up cloth having its lower edge cut in a circular arc shape, such a cloth for a skirt shown in FIG. 1, stitching portions of the upper and lower cloth are necessarily twisted to get out of shape if they are fed in an identical manner. Accordingly, in the prior art, such a lower edge cut in a circular arc shape is pre-stitched by a conventional sewing machine to form gathers at places and then must fold back (a condition shown in FIG. 2) to blind stitch the upper and lower cloth (1′) and (2′). There are troubles with such a performance, and also its efficiency is remarkably bad.

In order to solve the above mentioned defects in the prior sewing machine, one object of the present invention is to provide an improved cloth feed device for blind stitch sewing machines, thereby being capable of feeding the upper and lower cloth at the folded portions, respectively.

Another object of the present invention is to provide a cloth feed device for blind stitch sewing machines which can adjust properly a cloth feed speed of the upper and lower cloth folded back.

Figure 3:
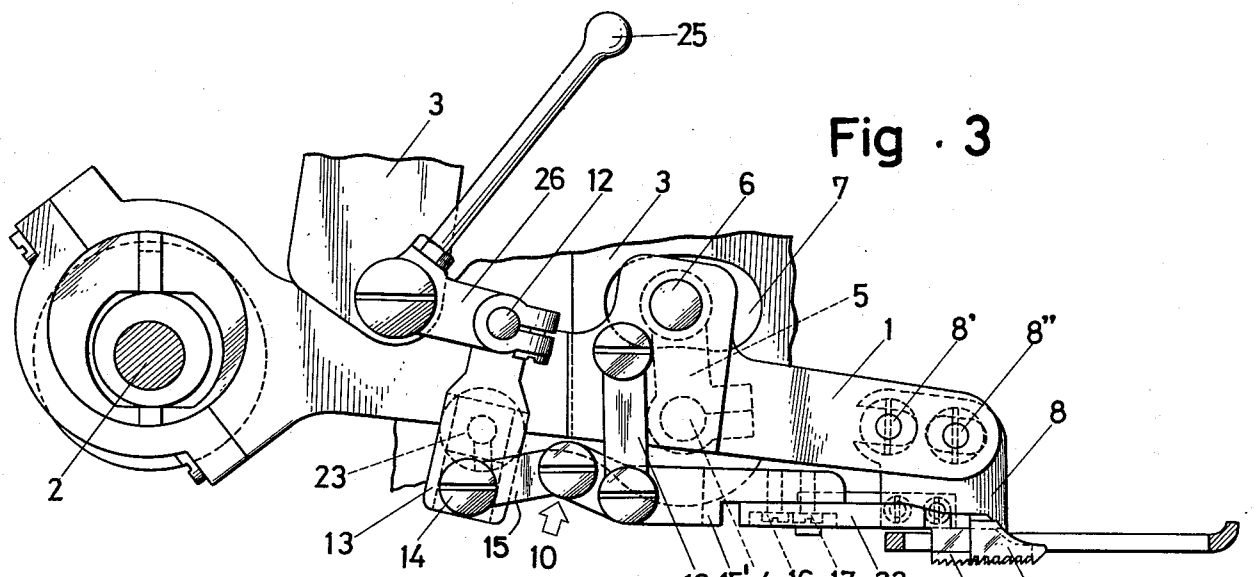
FIG. 3 is an elevational view of a cloth feed device for blind stitch sewing machines according to the present invention.
Figure 4:
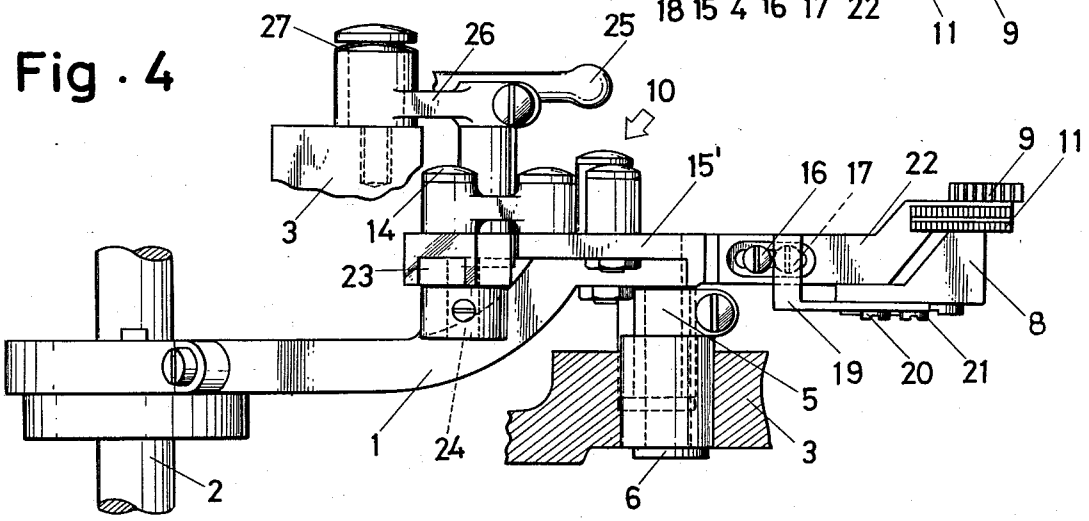
FIG. 4 is a bottom plan view of the cloth feed device of FIG. 3.

Referring now to FIG. 3, indicated by reference numeral 1 is a cloth feed lever which at its left end of the Figure is attached in a main driving shaft 2 of a sewing machine body in an eccentric relation and which at its central portion is attached by a pin 6 to a lever 5 pivotably mounted on a frame 3 by a pin 4. Indicated by reference numeral 7 is a long bore formed in the frame 3.

Accordingly, if the main driving shaft 2 rotates, the cloth feed lever 1 moves to draw an elliptic locus vertically and transversely in FIG. 3. In other manner, the cloth feed lever 1 may move vertically and transversely through the intermediary of its projection fitted with a cam groove which is formed in the frame 3.

At an end of the cloth feed lever 1, a depending piece 8 is threadedly secured by screws 8′ and 8″ and a main feed rack 9 may be used to allow the same cloth feed as the conventional blind stitch sewing machine. According to the present invention, the cloth feed lever 1 is adapted to connect an auxiliary feed lever 10, on one end of which is mounted an auxiliary feed rack 11 in parallel relationship with the main feed rack 9. The auxiliary feed lever 10 is engaged to the cloth feed lever 1 at one end of a locking link 13 by means of a pin 14, and at the other end of the locking link is attached by a pin 12 to frame 3. The locking link 13 is connected to transmitting links 15 and 15′ and the auxiliary feed rack 11 is secured by screws 16 and 17 to one end of the transmitting link 15′. Attached by the cloth feed lever 1 is a supporting lever 18 of the transmitting link 15′.

Secured to the depending piece 8 of the main feed rack 9 by means of screws 20 and 21 is a supporting plate 19 which prevents dropping of the auxiliary feed rack 11 and which is fitted to slide at the bottom of a fixed plate 22 of the auxiliary feed rack 11.

Accordingly, the auxiliary feed lever 10 is followed to the same locus as the elliptic locus of the cloth feed lever 1. Strokes $S_1$ and $S_2$ of the main feed rack 9 and auxiliary feed rack 11 are adapted to actuate at a rate corresponding to an engaging condition to the cloth feed lever 1 of the locking link 13.

Figure 5:
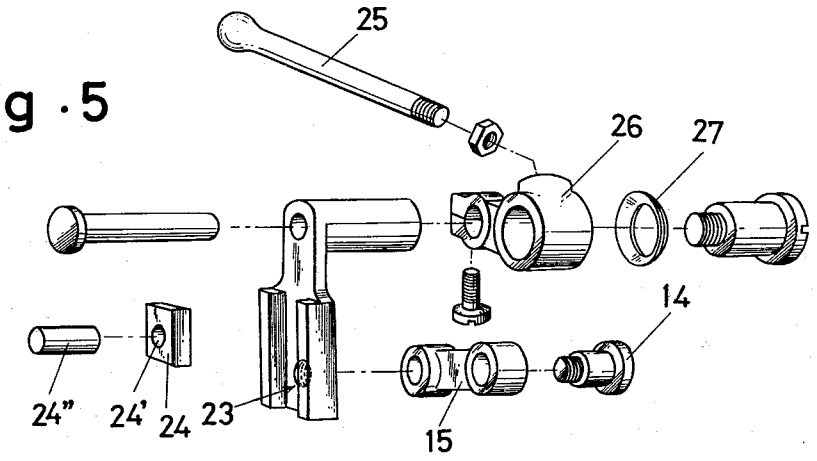
FIG. 5 is an exploded view showing a speed adjusting device for cloth feed rack.
Figure 6:
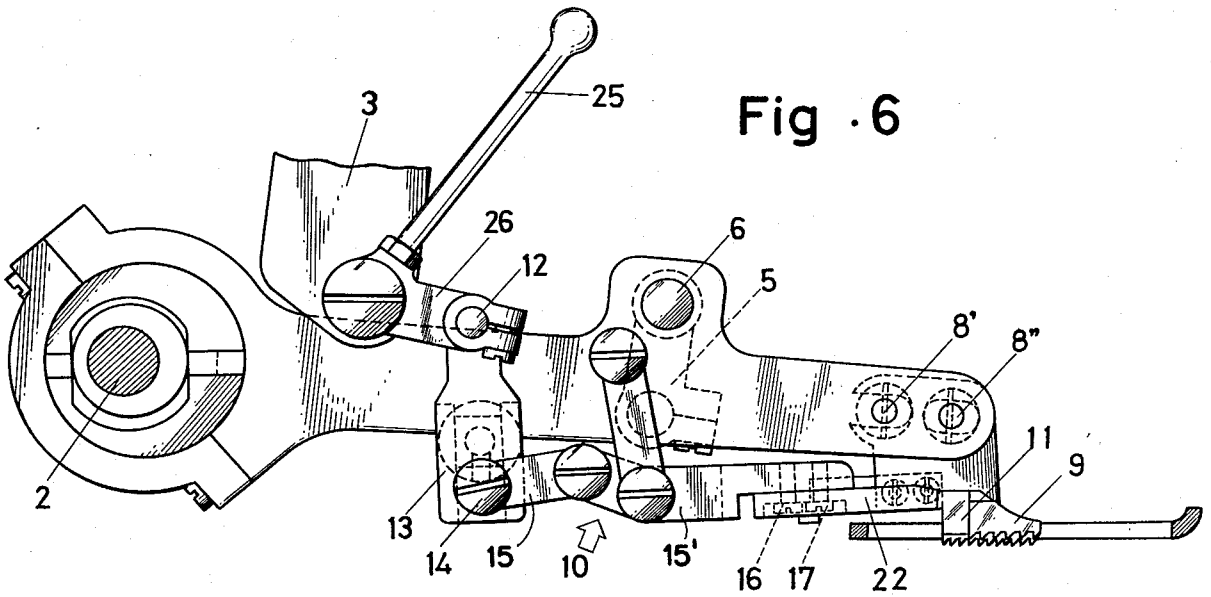
FIGS. 6 and 7 are elevational views showing the operation of the cloth feed device of FIG. 3, FIG. 6 showing its final feed and FIG. 7 showing initial feed, respectively.
Figure 7:
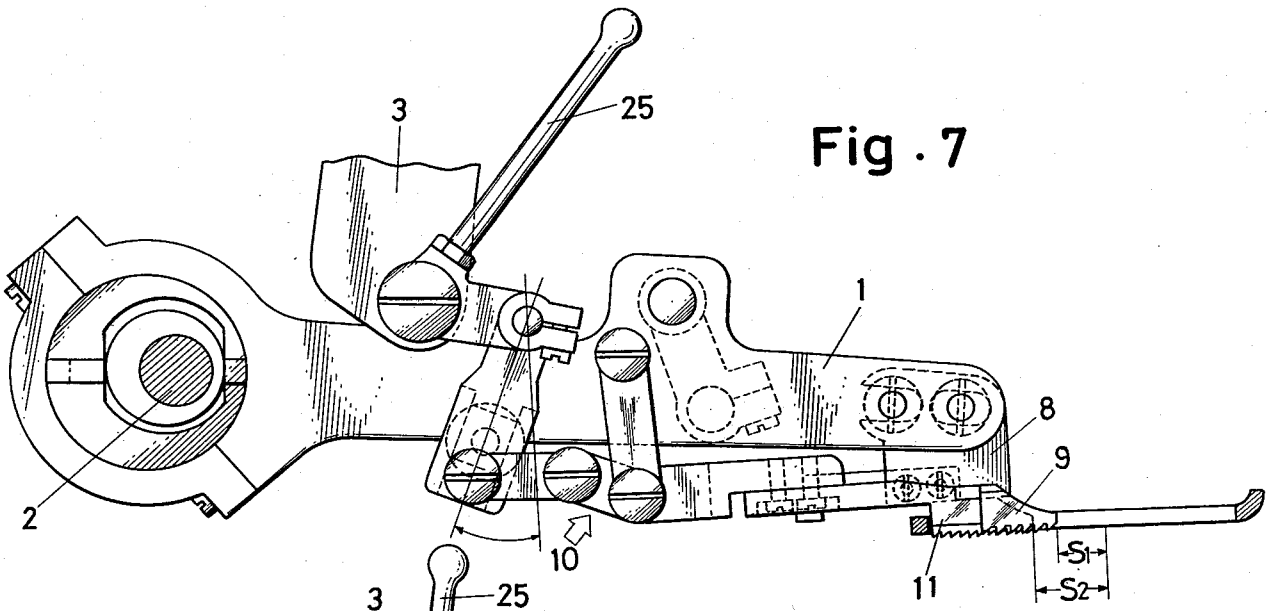

In a preferred embodiment of the present invention, the feed speed of the auxiliary feed rack 11 can be adjusted in accordance with the thickness, material and stitching requirements of a cloth to be stitched. As shown in FIG. 5, a slide groove 23 formed in the locking link 13 loosely fits a rectangular slider therein and the pin 24″ is inserted into a bore 24′ of the slider and is secured to the cloth feed lever 1.

The locking link 13 is connected by the pin 12 to a mounting frame 26 of an operating lever 25 which is attached on the frame 3. Indicated by reference numeral 27 is a washer type spring to prevent the operating lever 25 from deplacing by vibration or the like.

Figure 8:
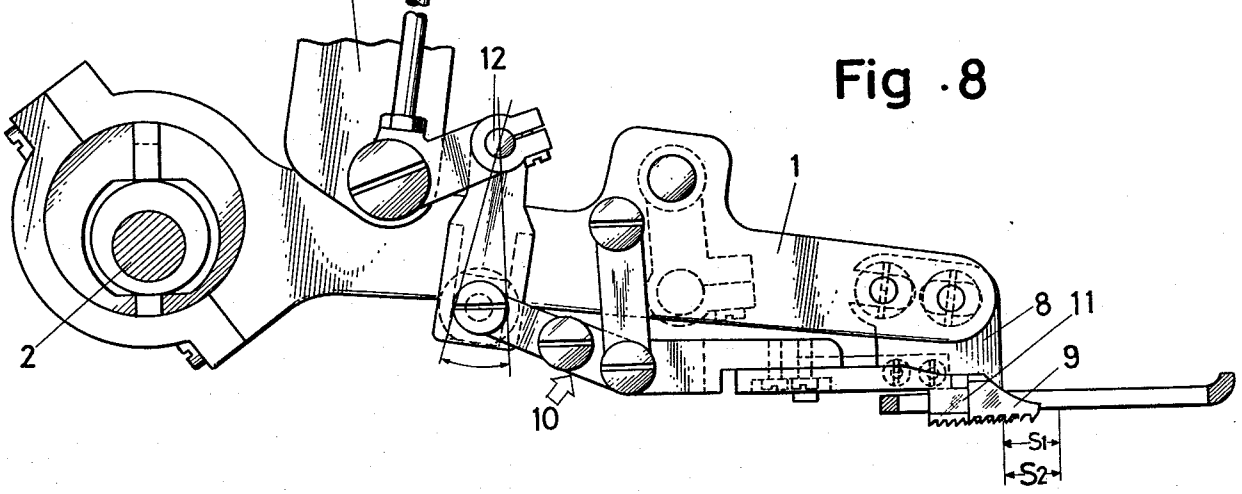
FIG. 8 is an elevational view showing an operational condition of the speed adjusting device shown in FIG. 5.

Therefore, movement of the cloth feed lever 1 is transmitted to the locking link 13 through the intermediary of the slider 24 and if the operating lever 25 is removed against the spring 27 (see FIG. 8) the slider 24 slides in the slide groove 23 of the locking link 13 whereby the stroke of the transmitting link 15' can be adjusted by different point of contact between the locking link 13 and the cloth feed lever 1.

In operation, upon stitching if the stroke $S_1$ of the cloth feed lever and the stroke $S_2$ of the auxiliary feed lever are adjusted to the cloth to be stitched and the folded upper cloth and the lower cloth are respectively abutted to the auxiliary feed rack 11 and the main feed rack 9, the folded upper cloth is not allowed to be late to the rear of the cloth feed. Accordingly, because it is not necessary to pre-stitch to form gathers in the case of stitching the arc lower edge, the folded portion will be simply blind stitched.

In the device of the present invention, since the main feed rack 9 and the auxiliary feed rack 11 are juxtaposed in a direction perpendicular to the cloth feed direction and the auxiliary feed rack 11 is adapted to receive the movement transmitted from cloth feed lever 1 while the stroke $S_2$ of the auxiliary feed rack 11 being adjustable arbitrarily, the upper and lower cloth at their folded portions can be positively fed by the main feed rack 9 and the auxiliary feed rack 11, respectively. Accordingly, in the case of blind stitching the padding cloth on the surface cloth, the upper cloth does not have at the rear of the feed direction and does not cause a twisted seam.

As understood from the above description, in the device of the present invention, the stitching work is simplified as compared with the conventional device and work efficiency can be remarkably improved. Further since the movement of the auxiliary feed rack 11 is transmitted from the cloth feed lever 1 through the locking link 13 and the transmitting links 15 and 15' it is not necessary to provide a particular driving shaft for the auxiliary feed rack 11 in the sewing machine body. In this case, since the movement of the cloth feed lever 1 is divided to transmit to the main feed rack 9 and the auxiliary feed rack 11, accordingly, the feed device obtained according to the present invention is simple in its structure, rare in occurrence of obstacle and small in size.

In the other feature of the present invention, the stroke of the auxiliary feed rack 11 is free to change with the operating lever 25 and therefore the auxiliary feed stroke can be adjusted in accordance with the thickness or shape of the cloth to be stitched. As understood from this, the cloth feed device of the invention can completely prevent the lag of the upper cloth to the rear of the feed direction upon blind stitching the upper and lower cloth.

As many apparently widely different embodiments of the present invention may be made without departing from the spirit and scope thereof, it is to be understood, that the invention is not limited to the specific embodiments thereof except as defined in the appended claims.

What is claimed is:

1. A cloth feed device for a blind stitch sewing machine comprising:

a sewing machine body;

a main shaft mounted on said body;

a frame mounted on said body;

a cloth feed lever connected at one end to said main shaft in eccentric relationship and mounted on said frame so as to allow vertical and transverse movements;

a main feed rack mounted on the other end of said cloth feed lever;

a pair of transmitting links connected to each other;

a supporting lever attaching one of said transmitting links to said cloth feed lever;

an auxiliary feed rack mounted on an end of said one of said pair of transmitting links and disposed along side and parallel to said main feed rack;

an adjustable locking link loosely fitted to said frame and connected to an end of the other of said pair of transmitting links opposite to said auxiliary feed rack;

a slider engaging said adjustable locking link and coupling it to said cloth feed lever; and an adjusting lever supported by said frame and connected to said locking link, whereby said main feed rack and said auxiliary feed rack operate at different feed rates and the feed rate of said auxiliary feed rack can be adjusted by moving said adjusting lever.

* * * * *